US008444727B2

(12) United States Patent
McHugh et al.

(10) Patent No.: US 8,444,727 B2
(45) Date of Patent: May 21, 2013

(54) METHOD OF MANUFACTURING CHEMICAL MECHANICAL POLISHING LAYERS

(75) Inventors: Kathleen McHugh, Newark, DE (US); James T. Murnane, Conshohocken, PA (US); George Harry McClain, Middletown, DE (US); Durron Andre Hutt, Wilmington, DE (US); Robert A Brady, Coatesville, PA (US); Christopher Alan Young, Newark, DE (US); Jeffrey Borcherdt Miller, West Chester, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 51 days.

(21) Appl. No.: 13/210,432

(22) Filed: Aug. 16, 2011

(65) Prior Publication Data

US 2013/0042536 A1 Feb. 21, 2013

(51) Int. Cl.
*C09K 3/14* (2006.01)

(52) U.S. Cl.
USPC ..... 51/298; 51/293; 425/130

(58) Field of Classification Search
None
See application file for complete search history.

(56) References Cited

U.S. PATENT DOCUMENTS

| | | | | |
|---|---|---|---|---|
| 3,677,681 | A | 7/1972 | Zippel et al. | |
| 3,954,926 | A * | 5/1976 | Pahl et al. | 264/46.4 |
| 4,144,295 | A | 3/1979 | Dever, Jr. | |
| 4,687,531 | A * | 8/1987 | Potoczky | 156/245 |
| 5,578,362 | A | 11/1996 | Reinhardt et al. | |
| 6,251,323 | B1 * | 6/2001 | Hoedl et al. | 264/254 |
| 2001/0011067 | A1 * | 8/2001 | Allan et al. | 510/152 |
| 2001/0016566 | A1 * | 8/2001 | Allan et al. | 510/447 |
| 2001/0039254 | A1 * | 11/2001 | Browne et al. | 510/440 |
| 2005/0147706 | A1 * | 7/2005 | Browne et al. | 425/289 |
| 2009/0053976 | A1 * | 2/2009 | Roy et al. | 51/298 |
| 2010/0068322 | A1 * | 3/2010 | Browne et al. | 425/130 |
| 2010/0207880 | A1 | 8/2010 | Shaver et al. | |

* cited by examiner

*Primary Examiner* — Kaj K Olsen
*Assistant Examiner* — Ross J Christie
(74) *Attorney, Agent, or Firm* — Thomas S. Deibert

(57) ABSTRACT

A method of manufacturing polishing layers for use in chemical mechanical polishing pads is provided, wherein the formation of density defects in the polishing layers is minimized.

20 Claims, 12 Drawing Sheets

METHOD OF MANUFACTURING CHEMICAL MECHANICAL POLISHING LAYERS

The present invention relates generally to the field of manufacture of polishing layers. In particular, the present invention is directed to a method of manufacturing polishing layers for use in chemical mechanical polishing pads.

In the fabrication of integrated circuits and other electronic devices, multiple layers of conducting, semiconducting and dielectric materials are deposited on or removed from a surface of a semiconductor wafer. Thin layers of conducting, semiconducting, and dielectric materials may be deposited by a number of deposition techniques. Common deposition techniques in modem processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damage, scratches, and contaminated layers or materials.

Chemical mechanical planarization, or chemical mechanical polishing (CMP), is a common technique used to planarize substrates, such as semiconductor wafers. In conventional CMP, a wafer is mounted on a carrier assembly and positioned in contact with a polishing pad in a CMP apparatus. The carrier assembly provides a controllable pressure to the wafer, pressing it against the polishing pad. The pad is moved rotated) relative to the wafer by an external driving force. Simultaneously therewith, a chemical composition ("slurry") or other polishing solution is provided between the wafer and the polishing pad. Thus, the wafer surface is polished and made planar by the chemical and mechanical action of the pad surface and slurry.

Reinhardt et al., U.S. Pat. No. 5,578,362, discloses an exemplary polishing pad known in the art. The polishing pad of Reinhardt comprises a polymeric matrix having microspheres dispersed throughout. Generally, the microspheres are blended and mixed with a liquid polymeric material and transferred to a mold for curing. Conventional wisdom in the art is to minimize perturbations imparted to the contents of the mold cavity during the transferring process. To accomplish this result, the location of the nozzle opening through which the curable material is added to the mold cavity is conventionally maintained centrally relative to the cross section of the mold cavity and as stationary as possible relative to the top surface of the curable material as it collects in the mold cavity. Accordingly, the location of the nozzle opening conventionally moves only in one dimension to maintain a set elevation above the top surface of the curable material in the mold cavity throughout the transferring process. The molded article is then sliced to form polishing layers. Unfortunately, polishing layers formed in this manner may exhibit unwanted defects (e.g., density defects).

Density defects are manifested as variations in the bulk density of the polishing layer material. In other words, areas having a lower filler concentration (e.g., microspheres in the Reinhardt polishing layers). Density defects are undesirable because it is believed that they may cause unpredictable, and perhaps detrimental, polishing performance variations from one polishing layer to the next and within a single polishing layer over its useful lifetime.

Notwithstanding, there is a continuing need for improved methods of manufacturing polishing layers for chemical mechanical polishing pads, wherein the formation of undesirable density defects are further minimized or eliminated.

The present invention provides a method of forming a polishing layer for a chemical mechanical polishing pad, comprising: providing a mold, having a mold base and a surrounding wall, wherein the mold base and the surrounding wall define a mold cavity, wherein the mold base is oriented along an x-y plane, wherein the mold cavity has a central axis, $C_{axis}$, that is perpendicular to the x-y plane, and wherein the mold cavity has a doughnut hole region and a doughnut region; providing a liquid prepolymer material; providing a plurality of microelements; providing a nozzle, having a nozzle opening; combining the prepolymer material with the plurality of microelements to form a curable mixture; charging the curable mixture through the nozzle opening to the mold cavity during a charging period, CP, wherein the charging period, CP, is broken down into three separate phases identified as an initial phase, a transition phase and a remainder phase; wherein the nozzle opening has a location and wherein the location of the nozzle opening moves relative to mold base along the mold cavity's central axis, $C_{axis}$, during the charging period, CP, to maintain the location of the nozzle opening above a top surface of the curable mixture in the mold cavity as the curable mixture collects in the mold cavity; wherein the location of the nozzle opening resides within the doughnut hole region throughout the initial phase; wherein the location of the nozzle opening transitions from residing within the doughnut hole region to residing within the doughnut region during the transition phase; wherein the location of the nozzle opening resides within the doughnut region during the remainder phase; allowing the curable mixture in the mold cavity to cure into a cake; and, deriving the polishing layer from the cake.

The present invention also provides a method of forming a polishing layer for a chemical mechanical polishing pad, comprising: providing a mold, having a mold base and a surrounding wall, wherein the mold base and the surrounding wall define a mold cavity, wherein the mold base is oriented along an x-y plane, wherein the mold cavity has a central axis, $C_{axis}$, that is perpendicular to the x-y plane, and wherein the mold cavity has a doughnut hole region and a doughnut region; providing a liquid prepolymer material; providing a plurality of microelements; providing a nozzle, having a nozzle opening; combining the liquid prepolymer material with the plurality of microelements to form a curable mixture; charging the curable mixture through the nozzle opening to the mold cavity during a charging period, CP, wherein the charging period, CP, is broken down into three separate phases identified as an initial phase, a transition phase and a remainder phase; wherein the nozzle opening has a location and wherein the location of the nozzle opening moves relative to mold base along the mold cavity's central axis, $C_{axis}$, during the charging period, CP, to maintain the location of the nozzle opening above a top surface of the curable mixture in the mold cavity as the curable mixture collects in the mold cavity; wherein the location of the nozzle opening resides within the doughnut hole region throughout the initial phase; wherein the location of the nozzle opening transitions from residing within the doughnut hole region to residing within the doughnut region during the transition phase; wherein the location of the nozzle opening resides within the doughnut region during the remainder phase; allowing the curable mixture in the mold cavity to cure into a cake; and, deriving the polishing layer from the cake; wherein the mold cavity approximates a right cylindrically shaped region having a substantially circular cross section, $C_{x\text{-}sect}$; wherein the mold cavity has an axis of symmetry, $C_{x\text{-}sym}$, which coincides with the mold cavity's central axis, $C_{axis}$; wherein the right cylindrically shaped region has a cross sectional area, $C_{x\text{-}area}$, defined as follows:

$$C_{x\text{-}area}=\pi r_C^2,$$

wherein $r_C$ is the average radius of the mold cavity's cross sectional area, $C_{x\text{-}area}$, projected onto the x-y plane; wherein the doughnut hole region is a right cylindrically shaped region within the mold cavity that projects a circular cross section, $DH_{x\text{-}sect}$, onto the x-y plane and has an axis of symmetry, $DH_{axis}$; wherein the doughnut hole has a cross sectional area, $DH_{x\text{-}area}$, defined as follows:

$$DH_{x\text{-}area}=\pi r_{DH}^2,$$

wherein $r_{DH}$ is a radius of the doughnut hole region's circular cross section, $DH_{x\text{-}sect}$; wherein the doughnut region is a toroid shaped region within the mold cavity that projects an annular cross section, $D_{x\text{-}sect}$, onto the x-y plane and that has a doughnut region axis of symmetry, $D_{axis}$; wherein the annular cross section, $D_{x\text{-}sect}$, has a cross sectional area, $D_{x\text{-}area}$, defined as follows:

$$D_{x\text{-}area}=\pi R_D^2-\pi r_D^2$$

wherein $R_D$ is a larger radius of the doughnut region's annular cross section, $D_{x\text{-}sect}$; wherein $r_D$ is a smaller radius of the doughnut region's annular cross section, $D_{x\text{-}sect}$; wherein $r_D \geqq r_{DH}$; wherein $R_D > r_D$; wherein $R_D < r_C$; wherein each of the $C_{x\text{-}sym}$, the $DH_{axis}$ and the $D_{axis}$ are perpendicular to the x-y plane; wherein the curable mixture is charged to the mold cavity at an essentially constant rate over the charging period, CP, with an average charging rate, $CR_{avg}$, of 0.015 to 2 kg/sec; wherein $r_D=r_{DH}$; wherein $r_D$ is 5 to 25 mm; wherein $R_D$ is 20 to 100 mm; wherein $r_C$ is 20 to 100 cm; and, wherein the cake produced using the method of the present invention contains fewer density defects compared to another cake produced using the same process except that throughout the charging period, CP, the location of the nozzle opening moves in only one dimension along the mold cavity's central axis, $C_{axis}$.

DETAILED DESCRIPTION

Figure 1:
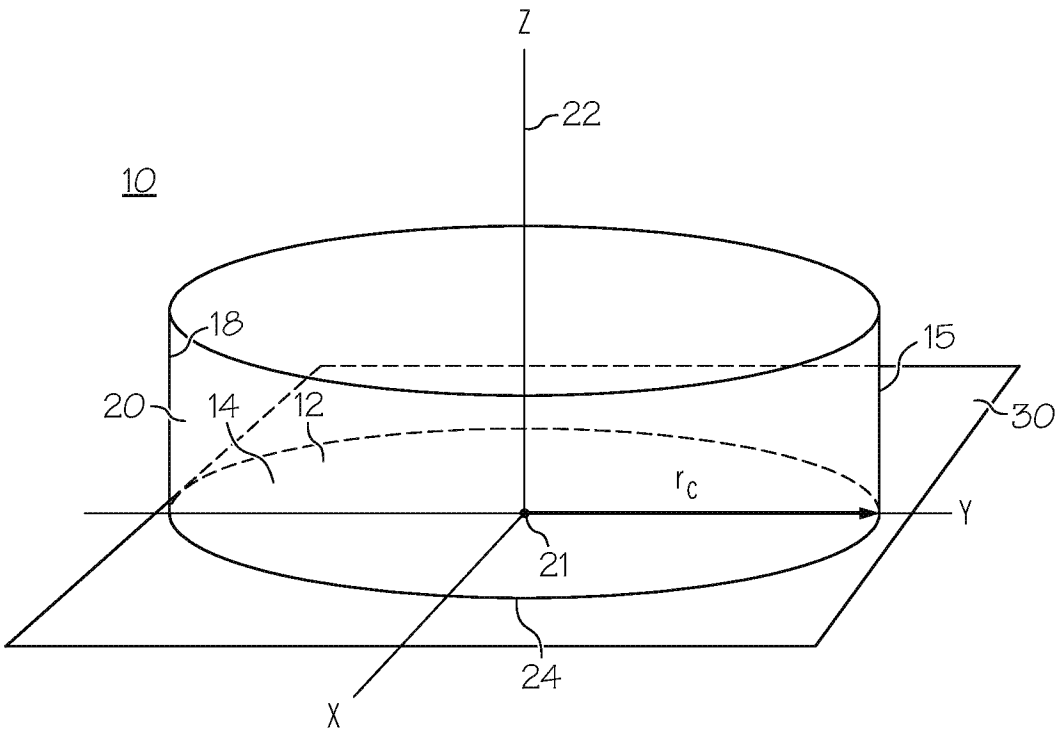
FIG. 1 is a depiction of a perspective top/side view of a mold having a mold cavity with a substantially circular cross section.

Surprisingly, it has been found that in the manufacture of polishing layers for chemical mechanical polishing pads, movement of the location of the nozzle opening through which a curable mixture is charged into a mold cavity in three dimensions both along and about a central axis, $C_{axis}$, of the mold cavity while charging the curable mixture into the mold cavity significantly reduces the occurrence of density defects in the polishing layers produced relative to those produced by an identical process, wherein the location of the nozzle opening moves in only one dimension along the mold cavity's central axis, $C_{axis}$.

The "charging period or CP" as used herein and in the appended claims refers to the period of time (in seconds) over which curable material is charged into the mold cavity starting at the moment when the first of the curable material is introduced into the mold cavity until the moment when the last of the curable material is introduced into the mold cavity.

The "charging rate or CR" as used herein and in the appended claims refers to the mass flow rate (in kg/sec) at which the curable material is charged to the mold cavity during the charging period, CP, (in seconds).

The "initial phase starting point or $SP_{IP}$" as used herein and in the appended claims refers to the location of the nozzle opening at the start of the initial phase of the charging period, which coincides with the start of the charging period.

The "initial phase ending point or $EP_{IP}$" as used herein and in the appended claims refers to the location of the nozzle opening at the end of the initial phase of the charging period, which immediately precedes the start of the transition phase of the charging period.

The "initial phase path" as used herein and in the appended claims refers to the path of movement (if any) of the location of the nozzle opening during the initial phase of the charge period from the initial phase starting point, $SP_{IP}$, to the initial phase ending point, $EP_{IP}$.

The "transition phase starting point or $SP_{TP}$" as used herein and in the appended claims refers to the location of the nozzle opening at the start of the transition phase of the charging period. The transition phase starting point, $SP_{TP}$, and the initial phase ending point, $EP_{IP}$, are at the same location.

The "transition phase transition point(s) or $TP_{TP}$" as used herein and in the appended claims refers to the location(s) of the nozzle opening during the transition phase of the charging period at which the direction of movement of the location of the nozzle opening relative to the mold cavity's central axis, $C_{axis}$, changes (i.e., the direction of movement in the x and y dimensions).

The "transition phase ending point or $EP_{TP}$" as used herein and in the appended claims refers to the first location of the nozzle opening within the doughnut region of a mold cavity at which the direction of movement of the location of the nozzle opening relative to the mold cavity's central axis, $C_{axis}$, changes. The transition phase ending point, $EP_{TP}$, is also the location of the nozzle opening at the end of the transition phase of the charging period, which immediately precedes the remainder phase of the charging period.

The "transition phase path" as used herein and in the appended claims refers to the path taken by the location of the nozzle opening during the transition phase of the charging period from the transition phase starting point, $SP_{TP}$, to the transition phase ending point, $EP_{TP}$.

The "remainder phase starting point or $SP_{RP}$" as used herein and in the appended claims refers to the location of the nozzle opening at the start of the remainder phase of the charging period. The remainder phase starting point, $SP_{RP}$, and the transition phase ending point, $EP_{TP}$, are at the same location.

The "remainder phase transition points or $TP_{RP}$" as used herein and in the appended claims refer to the locations of the nozzle opening during the remainder phase of the charging period at which the direction of movement of the location of the nozzle opening relative to the mold cavity's central axis, $C_{axis}$, changes.

The "remainder phase ending point or $EP_{RP}$" as used herein and in the appended claims refers to the location of the nozzle opening at the end of the remainder phase of the charging period, which coincides with the end of the charging period.

The "remainder phase path" as used herein and in the appended claims refers to the path taken by the location of the nozzle opening during the remainder phase of the charging period from the remainder phase starting point, $SP_{RP}$, to the remainder phase ending point. $EP_{RP}$.

The term "poly(urethane)" as used herein and in the appended claims encompasses (a) polyurethanes formed from the reaction of (i) isocyanates and (ii) polyols (including diols); and, (b) poly(urethane) formed from the reaction of (i) isocyanates with (ii) polyols (including diols) and (iii) water, amines or a combination of water and amines.

The term "essentially constant" as used herein and in the appended claims in reference to the charging rate of curable mixture during the charging period means that the following expressions are both satisfied:

$$CR_{max} \leqq (1.1 * CR_{avg})$$

$$CR_{min} \geqq (0.9 * CR_{avg})$$

wherein $CR_{max}$ is the maximum mass flow rate (in kg/sec) at which the curable material is charged to the mold cavity during the charging period; wherein $CR_{min}$ is the minimum mass flow rate (in kg/sec) at which the curable material is charged to the mold cavity during the charging period; and wherein $CR_{avg}$ the total mass (in kg) of curable material charged to the mold cavity over the charging period divided by the length of the charging period (in seconds).

The term "gel time" as used herein and in the appended claims in reference to a curable mixture means the total cure time for that mixture as determined using a standard test method according to ASTM D3795-00a (Reapproved 2006) (*Standard Test Method for Thermal Flow, Cure, and Behavior Properties of Pourable Thermosetting Materials by Torque Rheometer*).

The term "substantially circular cross section" as used herein and in the appended claims in reference to a mold cavity (20) means that the longest radius, $r_C$, of the mold cavity (20) projected onto the x-y plane (30) from the mold cavity's central axis, $C_{axis}$, (22) to a vertical internal boundary (18) of a surrounding wall (45) is ≦20% longer than the shortest radius, $r_C$, of the mold cavity (20) projected onto the x-y plane (30) from the mold cavity's central axis, $C_{axis}$, (22) to the vertical internal boundary (18). (See FIG. 1).

Figure 2:
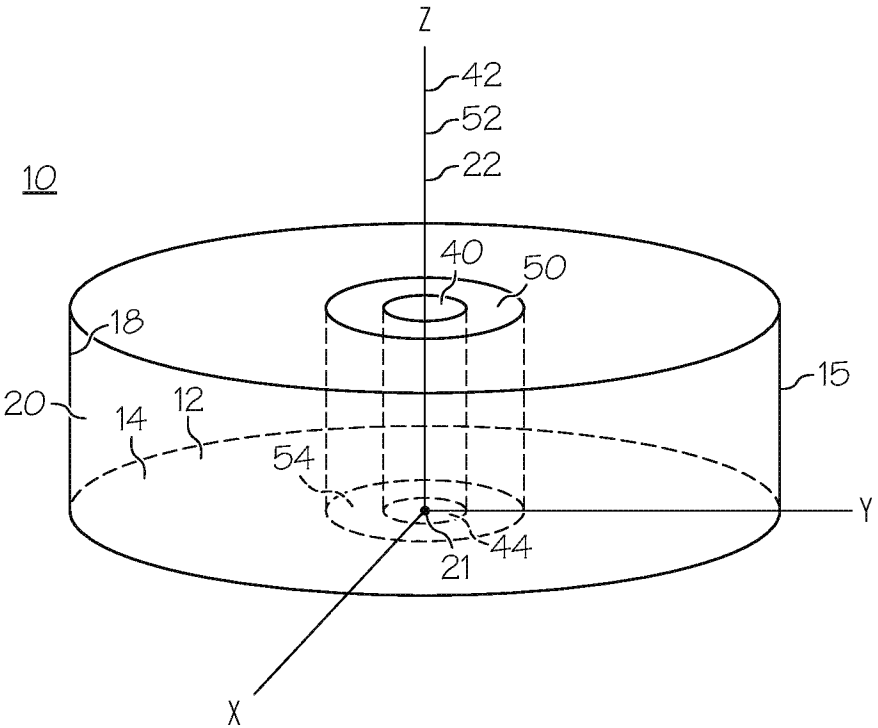
FIG. 2 is a depiction of a perspective top/side view of a mold having a mold cavity with a substantially circular cross section depicting a doughnut hole region and a doughnut region within the mold cavity.

The term "mold cavity" as used herein and in the appended claims refers to the volume defined by a horizontal internal boundary (14) of a mold base (12) and a vertical internal boundary (18) of a surrounding wall (15). (See FIGS. 1-2).

The term "substantially perpendicular" as used herein and in the appended claims in reference to a first feature (e.g., a horizontal internal boundary; a vertical internal boundary) relative to a second feature (e.g., an axis, an x-y plane) means that the first feature is at an angle of 80 to 100° to the second feature.

The term "essentially perpendicular" as used herein and in the appended claims in reference to a first feature (e.g., a horizontal internal boundary; a vertical internal boundary) relative to a second feature (e.g., an axis, an x-y plane) means that the first feature is at an angle of 85 to 95° to the second feature.

The term "density defect" as used herein and in the appended claims refers to a region in a polishing layer having a significantly reduced filler concentration relative to the rest of the polishing layer. Density defects are visually detectable with the unaided human eye upon placing the polishing layer on a light table, wherein the density defects appear as regions having a markedly higher transparency compared with the rest of the polishing layer.

Figure 7B:
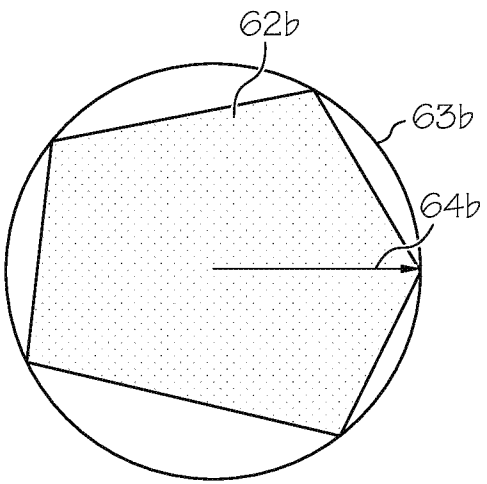
FIG. 7*b* is a depiction of a plan view of a nozzle opening, wherein the nozzle opening is non-circular.
Figure 7A:
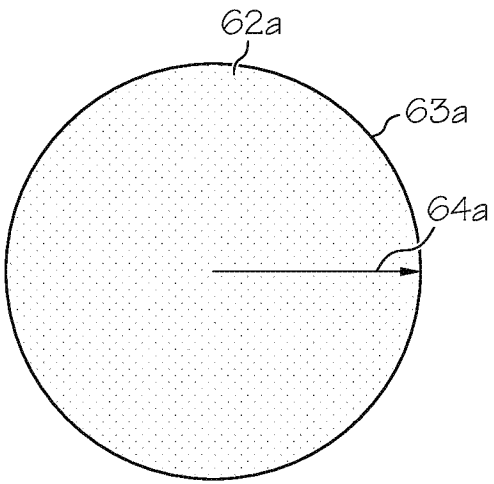
FIG. 7*a* is a depiction of a plan view of a nozzle opening, wherein the nozzle opening is circular.

The term "nozzle opening radius or $r_{NO}$" used herein and in the appended claims in reference to a nozzle opening means the radius, $r_{SC}$, of the smallest circle, SC, that can completely occlude the nozzle opening. That is, $r_{NO}=r_{SC}$. For illustrative purposes, see FIGS. 7*a* and 7*b*. FIG. 7*a* is a depiction of a plan view of a nozzle opening (62*a*) completely occluded by a smallest circle, SC, (63*a*) having a radius, $r_{SC}$, (64*a*); wherein the nozzle opening is circular. FIG. 7*b* is a depiction of a plan view of a nozzle opening (62*b*) completely occluded by a smallest circle, SC, (63*b*) having a radius, $r_{SC}$, (64*b*); wherein the nozzle opening is non-circular. Preferably, $r_{NO}$ is 5 to 13 mm. More preferably $r_{NO}$ is 8 to 10 null.

The mold base (12) of the mold (10) used in the method of the present invention defines a horizontal internal boundary (14) of the mold cavity (20). (See, e.g., FIGS. 1-2). Preferably, the horizontal internal boundary (14) of the mold cavity (20) is flat. More preferably, the horizontal internal boundary (14) of the mold cavity (20) is flat and is substantially perpendicular to the mold cavity's central axis, $C_{axis}$. Most preferably, the horizontal internal boundary (14) of the mold cavity (20) is flat and is essentially perpendicular to the mold cavity's central axis, $C_{axis}$.

The surrounding wall (15) of the mold (10) used in the method of the present invention defines a vertical internal boundary (18) of the mold cavity (20). (See, e.g., FIGS. 1-2). Preferably, the surrounding wall defines a vertical internal boundary (18) of the mold cavity (20) that is substantially perpendicular to the x-y plane (30). More preferably, the surrounding wall defines an vertical internal boundary (18) of the mold cavity (20) that is essentially perpendicular to the x-y plane (30).

Figure 3:
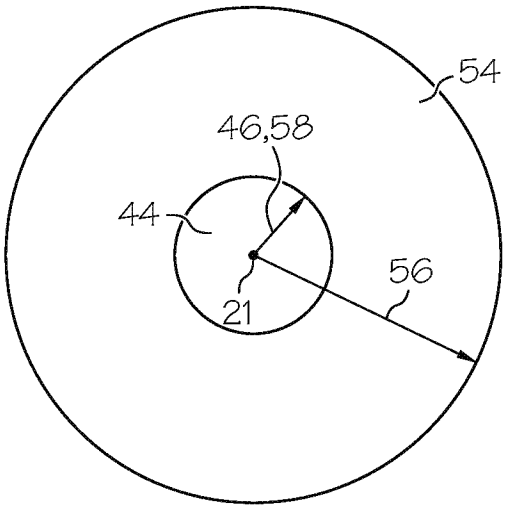
FIG. 3 is a depiction of a top plan view of the doughnut hole and doughnut region depicted in FIG. 2.

The mold cavity (20) has a central axis, $C_{axis}$, (22) that coincides with the z-axis and that intersects the horizontal internal boundary (14) of the mold base (12) at a center point (21). Preferably, the center point (21) is located at the geometric center of the cross section, $C_{x\text{-}sect}$, (24) of the mold cavity (20) projected onto the x-y plane (30). (See, e.g., FIGS. 1-3).

The mold cavity's cross section, $C_{x\text{-}sect}$, projected onto the x-y plan can be any regular or irregular two dimensional shape. Preferably, the mold cavity's cross section, $C_{x\text{-}sect}$, is selected from a polygon and an ellipse. More preferably, the mold cavity's cross section, $C_{x\text{-}sect}$, is a substantially circular cross section having an average radius, $r_C$ (preferably, wherein $r_C$ is 20 to 100 cm; more preferably, wherein $r_C$ is 25 to 65 cm; most preferably, wherein $r_C$ is 40 to 60 cm). Most preferably, the mold cavity approximates a right cylindrically shaped region having a substantially circular cross section, $C_{x\text{-}sect}$; wherein the mold cavity has an axis of symmetry, $C_{x\text{-}sym}$, which coincides with the mold cavity's central axis, $C_{axis}$; wherein the right cylindrically shaped region has a cross sectional area, $C_{x\text{-}area}$, defined as follows:

$$C_{x\text{-}area}=\pi r_C^2,$$

wherein $r_C$ is the average radius of the mold cavity's cross sectional area, $C_{x\text{-}area}$, projected onto the x-y plane; and wherein $r_C$ is 20 to 100 cm (more preferably 25 to 65 cm; most preferably 40 to 60 cm).

The mold cavity (20) has a doughnut hole region (40) and a doughnut region (50). (See, e.g., FIGS. 2-3).

Preferably, the doughnut hole region (40) of the mold cavity (20) is a right cylindrically shaped region within the mold cavity (20) that projects a circular cross section, $DH_{x\text{-}sect}$, (44) onto the x-y plane (30) and that has a doughnut hole region axis of symmetry, $DH_{axis}$, (42); wherein the $DH_{axis}$ coincides with the mold cavity's central axis, $C_{axis}$, and the z-axis. (See, e.g., FIGS. 2-3). The circular cross section, $DH_{x\text{-}sect}$, (44) of the doughnut hole region (40) has a cross sectional area, $DH_{x\text{-}area}$, defined as follows:

$$DH_{x\text{-}area}=\pi r_{DH}^2,$$

wherein $r_{DH}$ is the radius (46) of the doughnut hole region's circular cross section, $DH_{x\text{-}sect}$, (44). Preferably, wherein $r_{DH}\leqq r_{NO}$ (more preferably, wherein $r_{DH}$ is 5 to 25 nm; most preferably, wherein $r_{DH}$ 8 to 15 mm).

Preferably, the doughnut region (50) of the mold cavity (20) is a toroid shaped region within the mold cavity (20) that projects an annular cross section, $D_{x\text{-}sect}$, (54) onto the x-y plane (30) and that has a doughnut region axis of symmetry, $D_{axis}$, (52); wherein the $D_{axis}$ coincides with the mold cavity's central axis, $C_{axis}$, and the z-axis. (See, e.g., FIGS. 2-3). The annular cross section, $D_{x\text{-}sect}$, (54) of the doughnut region (50) has a cross sectional area, defined as follows:

$$D_{x\text{-}area}=\pi R_D^2-\pi r_D^2,$$

wherein $R_D$ is the larger radius (56) of the doughnut region's annular cross section, $D_{x\text{-}sect}$; wherein $r_D$ is the smaller radius (58) of the doughnut region's annular cross section, $D_{x\text{-}sect}$; wherein $r_D\geqq r_{DH}$; wherein $R_D>r_D$; and wherein $R_D<r_C$. Preferably, wherein $r_D\geqq r_{DH}$ and wherein $r_D$ is 5 to 25 mm. More preferably, wherein $r_D\geqq r_{DH}$ and wherein $r_D$ is 8 to 15 mm. Preferably, wherein $r_D\geqq r_{DH}$; wherein $R_D>r_D$; and wherein $R_D\leqq(K*r_C)$, wherein K is 0.01 to 0.2 (more preferably, wherein K is 0.014 to 0.1; most preferably, wherein K is 0.04 to 0.086). More preferably, wherein $r_D\geqq r_{DH}$; wherein $R_D>r_D$; and wherein $R_D$ is 20 to 100 mm (more preferably, wherein $R_D$ is 20 to 80 mm; most preferably, wherein $R_D$ is 25 to 50 mm).

The length of the charging period, CP, in seconds can vary significantly. For example, the length of the charging period, CP, will depend on the size of the mold cavity, the average charging rate, $CR_{avg}$, and the properties of the curable mixture (e.g., gel time). Preferably, the charging period, CP, is 60 to 900 seconds (more preferably 60 to 600 seconds, most preferably 120 to 360 seconds), Typically, the charging period, CP, will be constrained by the gel time exhibited by the curable mixture. Preferably, the charging period, CP, will be less than or equal to the gel time exhibited by the curable mixture being charged to the mold cavity. More preferably, the charging period, CP, will be less than the gel time exhibited by the curable mixture.

The charging rate, CR, (in kg/sec) can vary over the course of the charging period, CP. For example, the charging rate, CR, can be intermittent. That is, the charging rate, CR, can momentarily drop to zero at one or more times over the course of the charging period. Preferably, the curable mixture is charged to the mold cavity at an essentially constant rate over the charging period. More preferably, the curable mixture is charged to the mold cavity at an essentially constant rate over the charging period CP, with an average charging rate, $CR_{avg}$, of 0.015 to 2 kg/sec (more preferably 0.015 to 1 kg/sec; most preferably 0.08 to 0.4 kg/sec).

The charging period, CP, is broken down into three separate phases identified as an initial phase, a transition phase and a remainder phase. The start of the initial phase corresponds with the start of the charging period, CP. The end of the initial phase immediately precedes the start of the transition phase. The end of the transition phase immediately precedes the start of the remainder phase. The end of the remainder phase corresponds with the end of the charging period, CP.

Figure 4A:
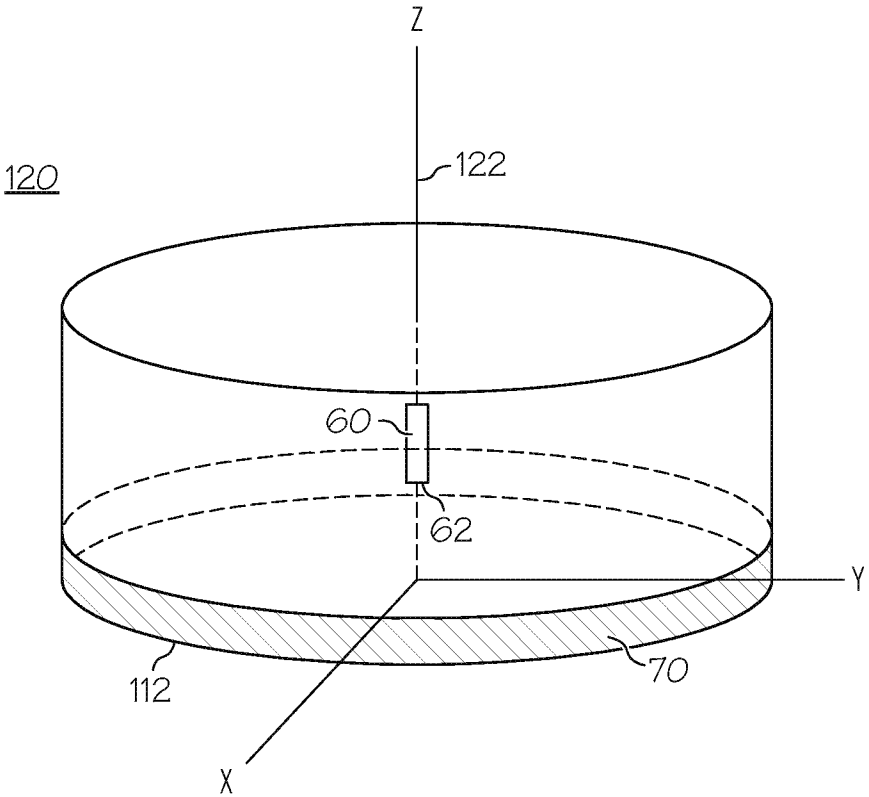
FIG. 4*a* is a depiction of a perspective top/side view of a mold cavity having a substantially circular cross section with a nozzle disposed within the mold cavity, wherein the mold cavity is partially filled with a curable mixture.
Figure 4B:
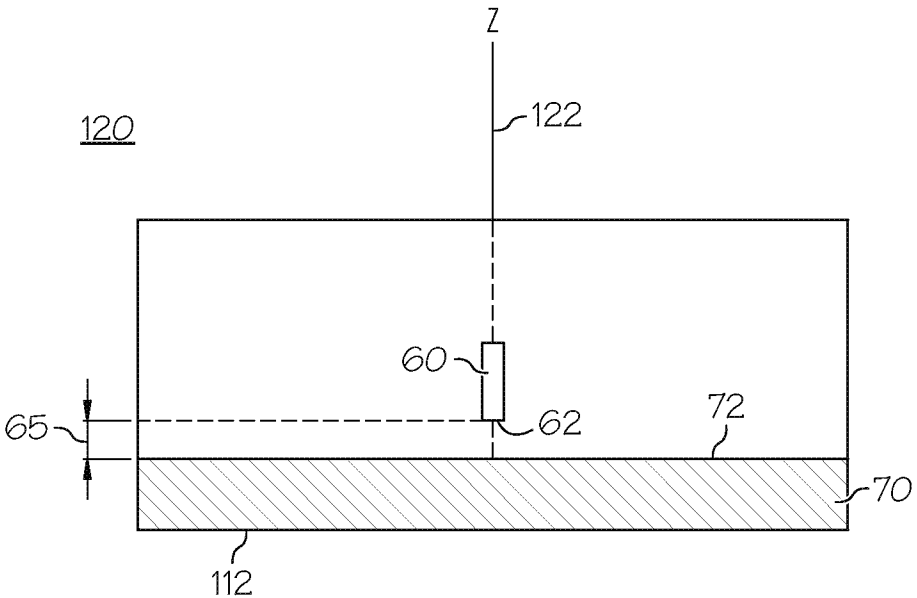
FIG. 4*b* is a depiction of a side elevation view of the mold cavity depicted in FIG. 4*a*.

The nozzle moves or transforms (e.g., telescopes) during the charging period, CP, such that the location of the nozzle opening moves in all three dimensions. The nozzle (60) moves or transforms (e.g., telescopes) during the charging period, CP, such that the location of the nozzle opening (62) moves relative to the mold base (112) along the mold cavity's central axis, $C_{axis}$, (122) during the charging period, CP, to maintain the location of the nozzle opening (62) above the top surface (72) of the curable mixture (70) as the curable mixture (70) collects in the mold cavity (120). (See FIGS. 4*a* and 4*b*), Preferably, the location of the nozzle opening (62) moves relative to the mold base (112) along the mold cavity's central axis, $C_{axis}$, (122) during the charging period, CP, to maintain the location of the nozzle opening (62) at an elevation (65) above the top surface (72) of the curable mixture (70) as the curable mixture (70) collects in the mold cavity (120); wherein the elevation is >0 to 30 mm (more preferably, >0 to 20 mm; most preferably, 5 to 10 mm). (See FIG. 4*b*). The location of the nozzle opening can momentarily pause in its motion along the mold cavity's central axis, $C_{axis}$, (i.e., its motion in the z dimension) during the charging period. Preferably, the location of the nozzle opening momentarily pauses in its motion relative to the mold cavity's central axis, $C_{axis}$, at each transition phase transition point, $TP_{TP}$, (if any) and at each remainder phase transition point, $TP_{RP}$ (i.e., the location of the nozzle opening momentarily stops moving in the z dimension).

The location of the nozzle opening resides within the doughnut hole region of the mold cavity throughout the initial phase of the charging period (i.e., for the duration of the initial phase). The location of the nozzle opening can remain stationary throughout the initial phase, wherein the initial phase starting point, $SP_{IP}$ and the initial phase ending point, $EP_{IP}$), are the same location (i.e., $SP_{IP}=EP_{IP}$). Preferably, when $SP_{IP}=EP_{IP}$, the initial phase is >0 to 90 seconds long (more preferably >0 to 60 seconds long; most preferably 5 to 30 seconds long). Most preferably, the location of the nozzle opening remains stationary from the start of the initial phase of the charging period until the top surface of curable mixture in the mold cavity begins to rise at which moment the transition phase begins; wherein the initial phase starting point, $SP_{IP}$), (80) and the initial phase ending point, $EP_{IP}$, (81*a*) (which point coincides with a transition phase starting point, $SP_{TP}$, (82*a*)) are the same location within the doughnut hole region (140) of the mold cavity (220) along the mold cavity's central axis, $C_{axis}$, (222). Preferably, wherein the doughnut hole region (140) is a right circular cylinder; and wherein the doughnut hole's axis of symmetry, $DH_{axis}$, (142) coincides with the mold cavity's central axis, $C_{axis}$, (222) and the z-axis. (See FIGS. 5*a*-5*c*). The location of the nozzle opening can move during the initial phase, wherein the initial phase starting point, $SP_{IP}$, is different from the initial phase ending point, $EP_{IP}$, (i.e., $SP_{IP} \neq EP_{IP}$). Preferably, when $SP_{IP} \neq EP_{IP}$; the initial phase is >0 to (CP-10.02) seconds long; wherein CP is the charge period in seconds. More preferably, when $SP_{IP} \neq EP_{IP}$; the initial phase is >0 to (CP-30) seconds long; wherein CP is the charge period in seconds. Most preferably, when the top surface of the curable material in the mold cavity (220) rises during the initial phase of the charging period, the location of the nozzle opening preferably moves within the doughnut hole region (140) of the mold cavity (220) along the mold cavity's central axis, $C_{axis}$, (222) from an initial phase starting point, $SP_{IP}$, (80) to an initial phase ending point, $EP_{IP}$, (81*b*) (which point coincides with a transition phase starting point, $SP_{TP}$, (82*b*)) to maintain the location of the nozzle opening at an elevation above the top surface of the curable material as it collects in the mold cavity (220) throughout the initial phase of the charging period. (See FIGS. 5*a*-5*e*).

The location of the nozzle opening moves from a point within the doughnut hole region of the mold cavity to a point within the doughnut region during the transition phase of the charging period. Preferably, the transition phase is 0.02 to 30 seconds tong (more preferably, 0.2 to 5 seconds long; most preferably, 0.6 to 2 seconds long). Preferably, the location of the nozzle opening moves relative to the mold cavity's central axis, $C_{axis}$, during the transition phase at an average speed of 10 to 70 mm/sec (more preferably 15 to 35 trim/sec, most preferably 20 to 30 mm/sec). Preferably, wherein the movement of the location of the nozzle opening momentarily pauses in its motion relative to the mold cavity's central axis, $C_{axis}$, (i.e., momentarily stops moving in the x and y dimensions) at each transition phase transition point, $TP_{TP}$, (if any) and at the transition phase ending point, $EP_{TP}$. Preferably, the location of the nozzle opening moves at a constant speed relative to the mold cavity's central axis, $C_{axis}$, during the transition phase from the transition phase starting point, $SP_{TP}$, through any transition phase transition points, $TP_{TP}$, to the transition phase ending point, $EP_{TP}$. Preferably, during the transition phase the location of the nozzle opening moves from the transition phase starting point, $SP_{TP}$, through a plurality of transition phase transition points, $TP_{TP}$, to the transition phase ending point, $EP_{TP}$; wherein the transition phase path projected onto the x-y plane approximates a curve (more preferably wherein the transition phase path approximates a spiral easement). Most preferably, during the transition phase the location of the nozzle opening moves directly from the transition phase starting point, $SP_{TP}$, to the transition phase ending point, $EP_{TP}$; wherein the transition phase path projected onto the x-y plane is a straight line.

Figure 5A:
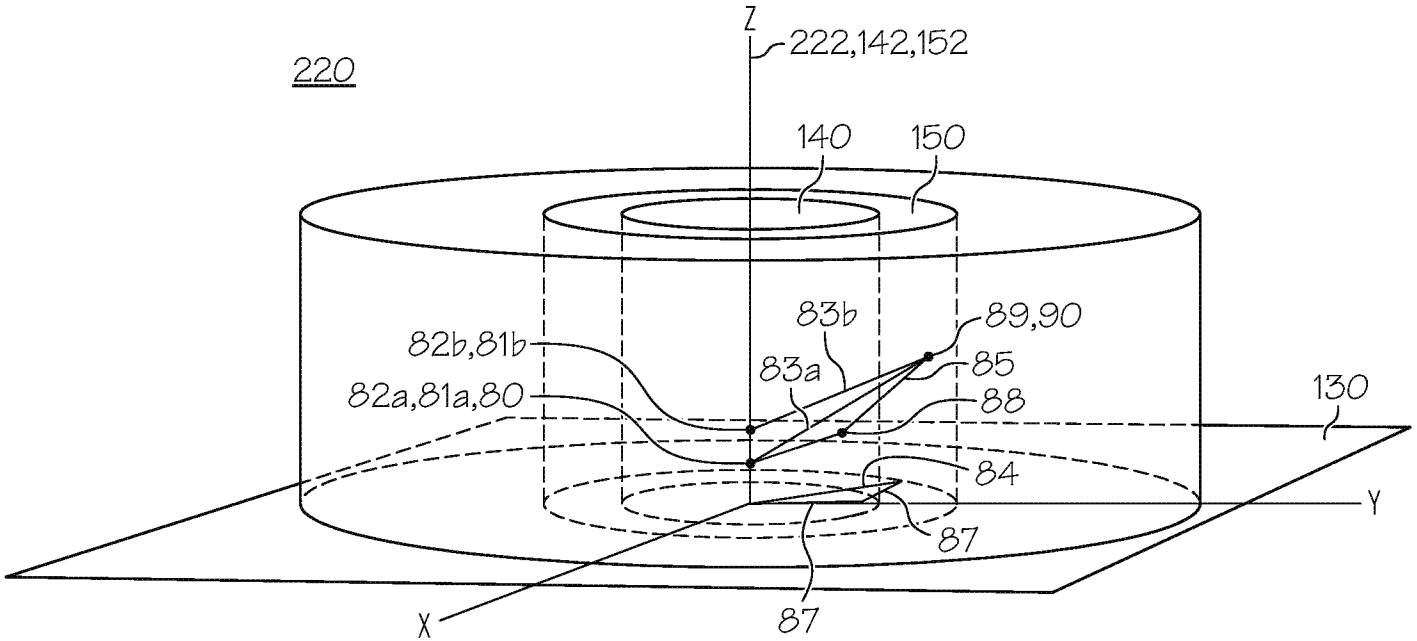
FIG. 5*a* is a depiction of a perspective top/side view of a mold cavity having a substantially circular cross section with a doughnut hole region and a doughnut region and depicting multiple exemplary initial phase and transition phase paths.
Figure 5B:
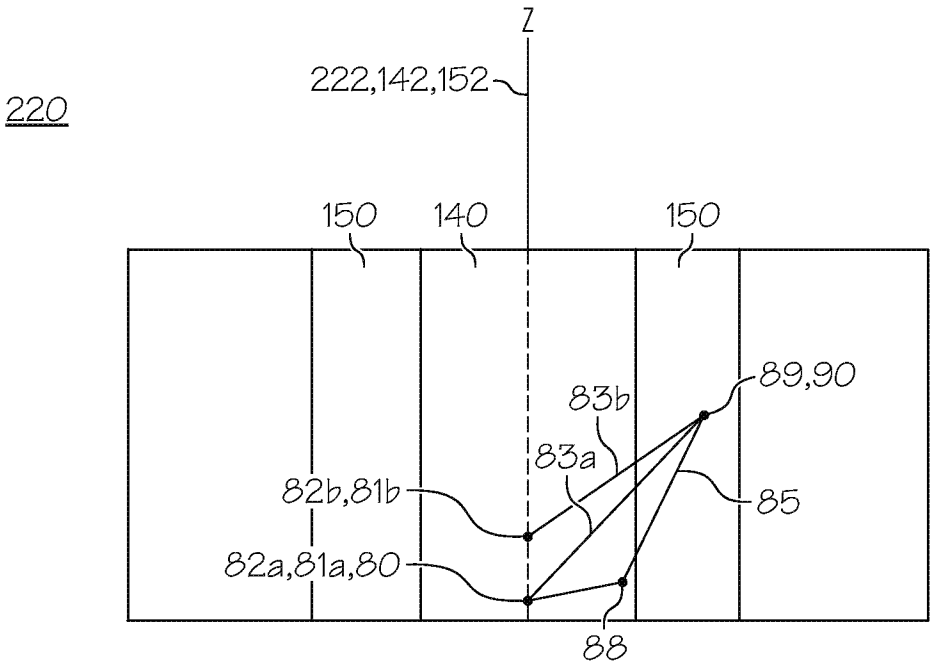
FIG. 5*b* is a depiction of a side elevation view of the mold cavity depicted in FIG. 5*a*.
Figure 5C:
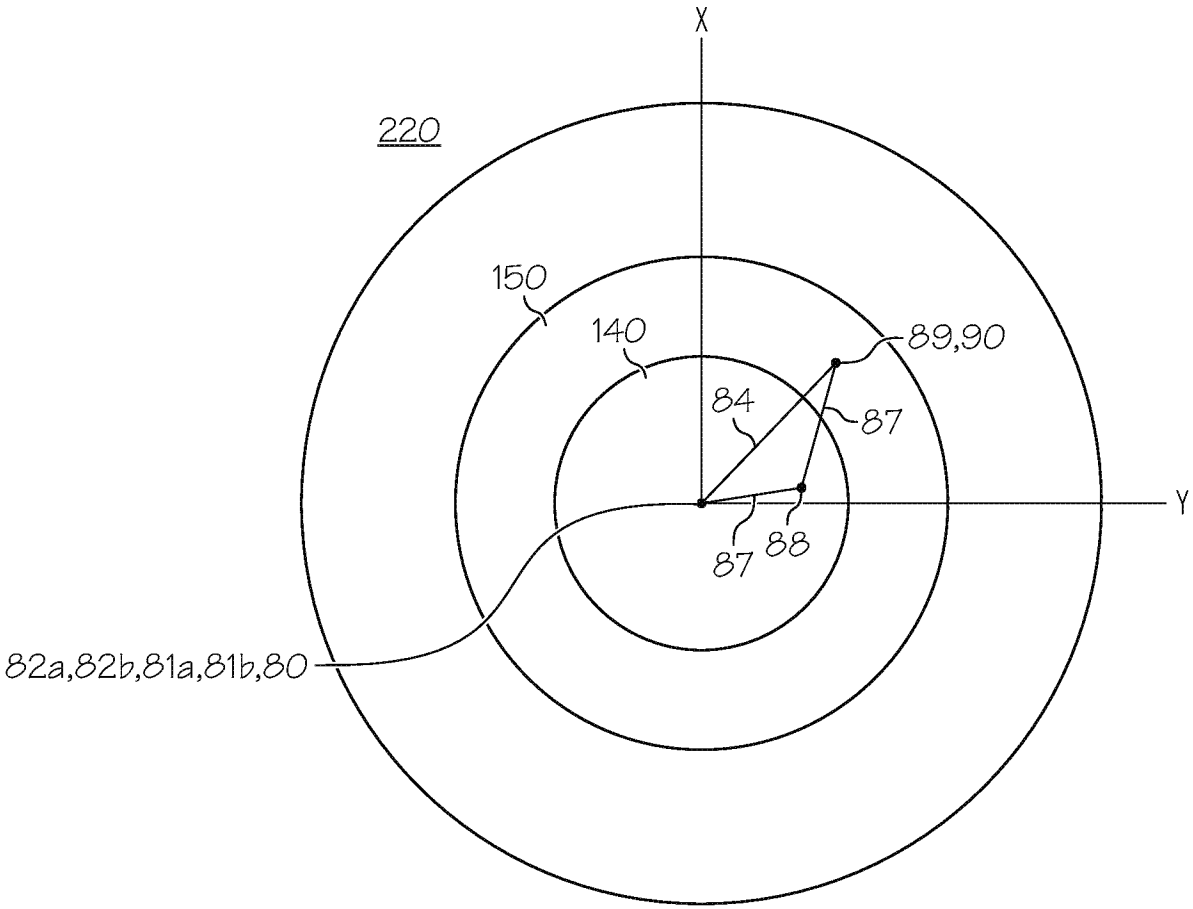
FIG. 5*c* is a depiction of a top plan view of the mold cavity depicted in FIG. 5*a* showing the projections onto the x-y plane of the initial phase and transition phase paths depicted in FIG. 5*a*.

FIGS. 5*a*-5*c* depict three different transition phase paths in a mold cavity (220) having a central axis, $C_{axis}$, (222); a right cylindrically shaped doughnut hole region (140) with an axis of symmetry, $DH_{axis}$, (142); and a toroid shaped doughnut region (150) with an axis of symmetry, $D_{axis}$, (152); wherein the mold cavity's central axis, $C_{axis}$, (222), the doughnut hole's axis of symmetry, $DH_{axis}$, (142) and the doughnut's axis of symmetry, $D_{axis}$, (152) each coincide with the z axis. A first transition phase path depicted in FIGS. 5*a*-5*c* begins at a transition phase starting point, $SP_{TP}$, (82*a*) within a doughnut hole region (140) of a mold cavity (220) and proceeds directly to a transition phase ending point, $EP_{TP}$, (89) within a doughnut region (150) of the mold cavity (220); wherein the transition phase path 83*a* projects as a single straight line (84) onto the x-y plane (130). A second transition phase path depicted in FIGS. 5*a*-5*c* begins at a transition phase starting point, $SP_{TP}$, (82*b*) within a doughnut hole region (140) of a mold cavity (220) and proceeds directly to a transition phase ending point, $EP_{TP}$, (89) within a doughnut region (150) of the mold cavity (220), wherein the transition phase path 83*b* projects as a single straight line (84) onto the x-y plane (130). A third transition phase path depicted in FIGS. 5*a*-5*c* begins at a transition phase starting point, $SP_{TP}$, (82*a*) within the doughnut hole region (140); transitions through a transition phase transition point, $TP_{TP}$, (88) within the doughnut hole region (140); and then proceeds to the transition phase ending point, $EP_{TP}$, (89) located within the doughnut region (150); wherein the transition phase path (85) projects a pair of connected lines (87) onto the x-y plane (130). Note that the transition phase end point, $EP_{TP}$, (89) corresponds with the remainder phase starting point, $SP_{RP}$, (90)(i.e., they are at the same location).

The location of the nozzle opening resides within the doughnut region during the remainder phase of the charging period (i.e., the location of the nozzle opening may pass through or reside in the doughnut hole region for some fraction of the remainder phase of the charging period). Preferably, the location of the nozzle opening resides within the doughnut region throughout the remainder phase of the charging period (i.e., for the duration of the remainder phase). Preferably, wherein the remainder phase is ≧10 seconds long. More preferably, the remainder phase is 10 to <(CP-0.2) seconds long; wherein CP is the charge period in seconds, Still more preferably, the remainder phase is 30 to <(CP-0.2) seconds long; wherein CP is the charge period in seconds. Most preferably, the remainder phase is 0.66*CP to <(CP-0.2) seconds long; wherein CP is the charge period in seconds. Preferably', the location of the nozzle opening moves relative to the mold cavity's central axis, $C_{axis}$, during the remainder phase at an average speed of 10 to 70 mm/sec (more preferably 15 to 35 mm/see, most preferably 20 to 30 min/sec). Preferably, the location of the nozzle opening can momentarily pause in its motion relative to the mold cavity's central axis, $C_{axis}$, at each remainder phase transition point, $TP_{RP}$ (i.e., the location of the nozzle opening can momentarily stop moving in the x and y dimensions). Preferably, the location of the nozzle opening moves at a constant speed relative to the mold cavity's central axis, $C_{axis}$, during the remainder phase from the remainder phase starting point, $SP_{RP}$, through each of the remainder phase transition points, $TP_{RP}$. Preferably, during the remainder phase the location of the nozzle opening moves from the remainder phase starting point, $SP_{RP}$, through a plurality of remainder phase transition points, $TP_{RP}$; wherein the remainder phase path projects a series of connected tines onto the x-y plane. Preferably, the remainder phase transition points, $TP_{RP}$, are all located within the doughnut region of the mold cavity. Preferably, the series of connected lines projected onto the x-y plane by the remainder phase path approximates either a circle or a two dimensional spiral with a varying distance from the mold cavity's central axis, $C_{axis}$. Preferably, the series of connected tines projected onto the x-y plane by the remainder phase path approximates a two dimensional spiral, wherein successive remainder phase transition points, $TP_{RP}$, project onto the x-y plane at either an increasing or a decreasing distance from the mold cavity's central axis, $C_{axis}$. More preferably, the series of connected lines projected onto the x-y plane by the remainder phase path approximates a circle, wherein successive remainder phase transition points, $TP_{RP}$, project onto the x-y plane at an equal distance from the mold cavity's central axis, $C_{axis}$, and wherein the series of connected lines projected onto the x-y plane by the remainder phase path is a regular polygon (i.e., equilateral and equiangular), Preferably, wherein the regular polygon has ≧5 sides (more preferably ≧8 sides; most preferably ≧10 sides; preferably ≦100 sides; more preferably ≦50 sides; most preferably ≦20 sides), Most preferably, wherein the remainder phase path approximates a helix. That is, during the remainder phase the location of the nozzle opening continues moving along the mold cavity's central axis, $C_{axis}$, to maintain the desired elevation above the top surface of the curable mixture collecting in the mold cavity while the location of the nozzle opening simultaneously traces a path that projects a regular polygon onto the x-y plane (preferably, wherein the regular polygon has 5 to 100 sides; more preferably, 5 to 50 sides; still more preferably, 8 to 25 sides; most preferably, 8 to 15 sides).

Figure 6A:
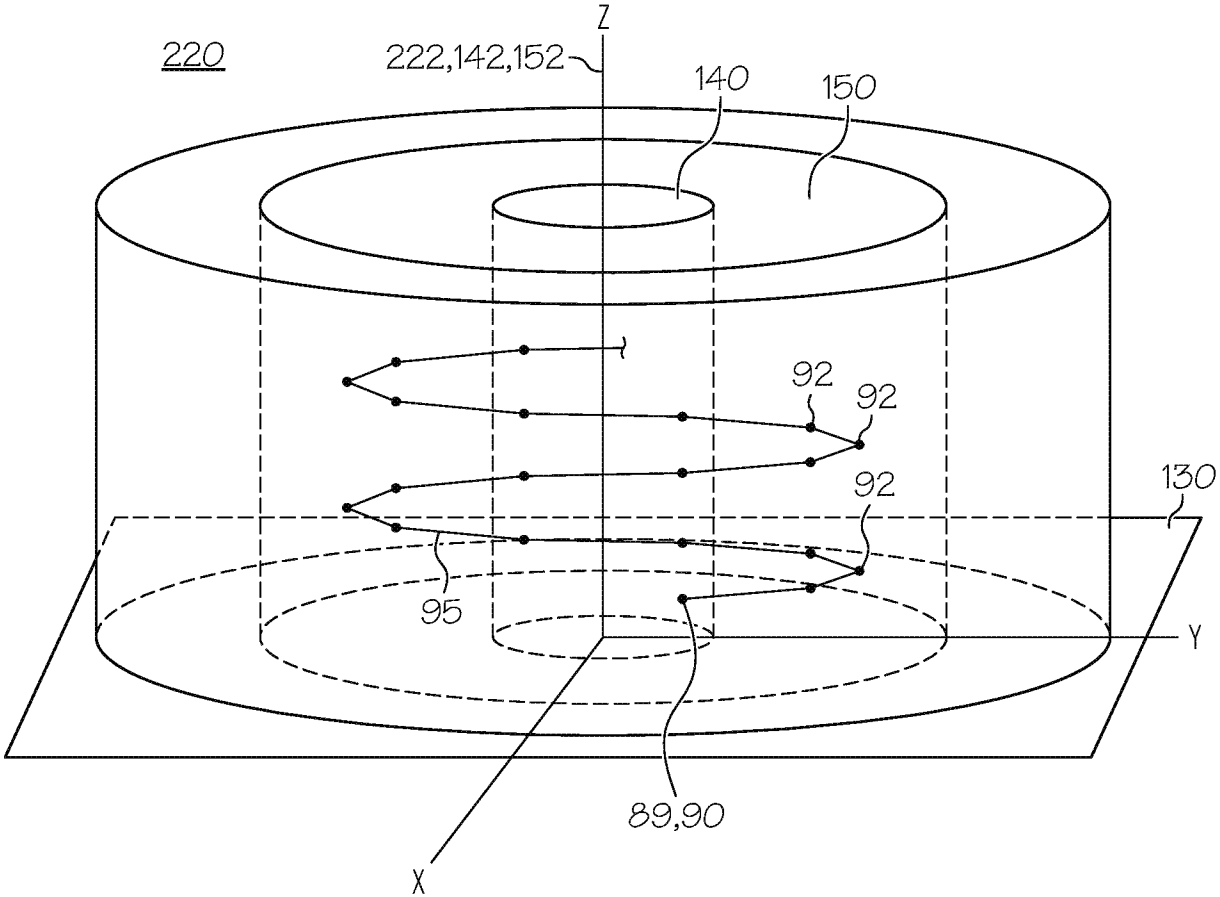
FIG. 6*a* is a depiction of a perspective top/side view of a mold cavity having a substantially circular cross section with a doughnut hole region and a doughnut region and depicting an exemplary remainder phase path.
Figure 6B:
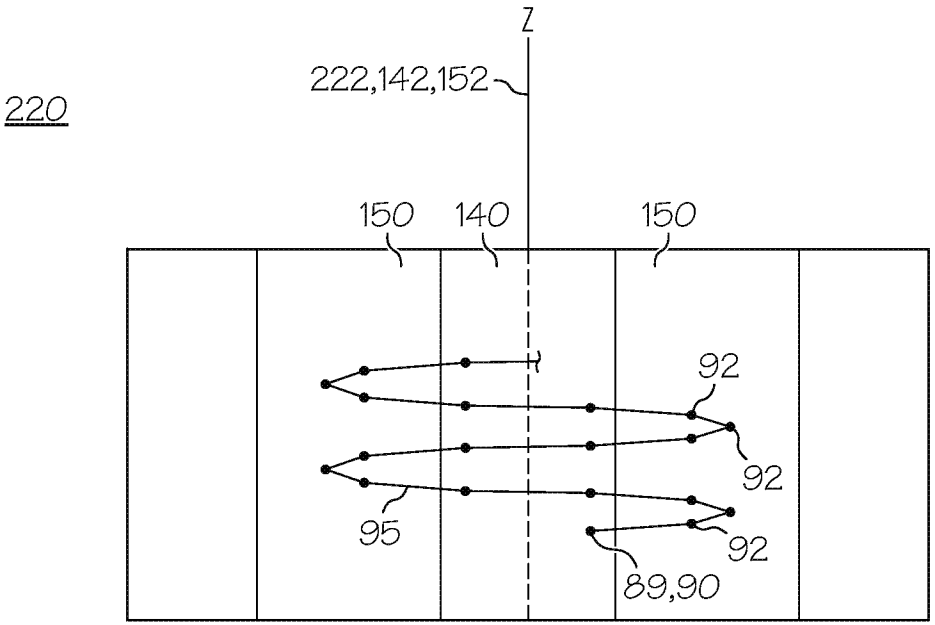
FIG. 6*b* is a depiction of a side elevation view of the mold cavity depicted in FIG. 6*a*.
Figure 6C:
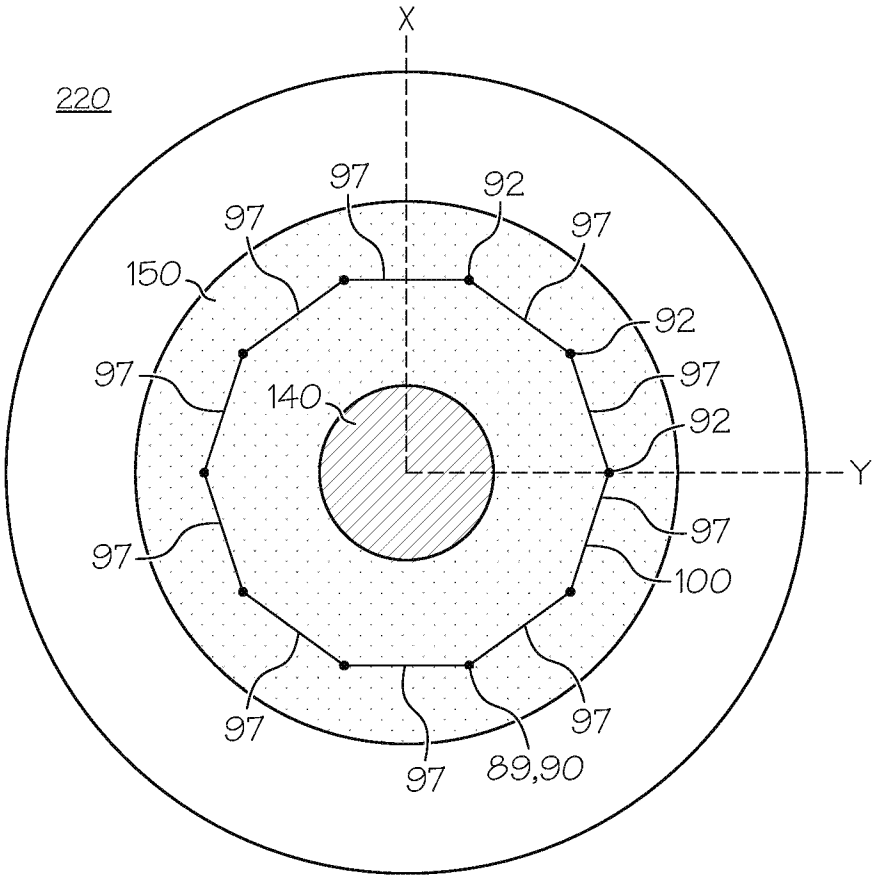
FIG. 6*c* is a depiction of a top plan view of the mold cavity depicted in FIG. 6*a* showing the projection onto the x-y plane of the remainder phase path depicted in FIG. 6*a*.

FIGS. 6*a*-6*c* depict a portion of a preferred remainder phase path (95) that approximates a helix within the mold cavity (220) having a central axis, $C_{axis}$, (222); a right cylindrically shaped doughnut hole region (140) with an axis of symmetry, $DH_{axis}$, (142); and a toroid shaped doughnut region (150) with an axis of symmetry, $D_{axis}$, (152); wherein the mold cavity's central axis, $C_{axis}$, (222), the doughnut hole's axis of symmetry, $DH_{axis}$, (142) and the doughnut's axis of symmetry, $D_{axis}$, (152) each coincide with the z axis. The remainder phase path (95) begins at a remainder phase starting point, $SP_{RP}$, (90) within the doughnut region (150) of the mold cavity (220) and proceeds through a plurality of remainder phase transition points, $TP_{RP}$, (92) within a doughnut region (150) of the mold cavity (220); wherein all the remainder phase transition points, $TP_{RP}$, are at an equal distance from the mold cavity's central axis, $C_{axis}$, (222); and, wherein the remainder phase path 95 projects onto the x-y plane (130) as ten equal length lines (97) forming a regular decahedron (100). Note that the remainder transition starting point, $SP_{RP}$, (90) corresponds with the transition phase ending point, $EP_{TP}$, (89) (i.e., they are at the same location).

The curable mixture preferably comprises a liquid prepolymer material and a plurality of microelements, wherein the plurality of microelements are uniformly dispersed in the prepolymer material.

The liquid prepolymer material preferably polymerizes (i.e., cures) to forma material selected from poly(urethane), polysulfone, polyether sulfone, nylon, polyether, polyester, polystyrene, acrylic polymer, polyurea, polyamide, polyvinyl chloride, polyvinyl fluoride, polyethylene, polypropylene, polybutadiene, polyethylene imine, polyacrylonitrite, polyethylene oxide, polyolefin, poly(alkyl)acrylate, poly(alkyl) methacrylate, polyamide, polyether imide, polyketone, epoxy, silicone, polymer formed from ethylene propylene diene monomer, protein, polysaccharide, polyacetate and a combination of at least two of the foregoing. Preferably, the liquid (prepolymer material polymerizes to form a material comprising a poly(urethane). More preferably, the liquid prepolymer material polymerizes to form a material comprising a polyurethane. Most preferably, the liquid prepolymer material polymerizes (cures) to form a polyurethane.

Preferably, the liquid prepolymer material comprises a polyisocyanate-containing material. More preferably, the liquid prepolymer material comprises the reaction product of a polyisocyanate (e.g., diisocyanate) and a hydroxyl-containing material.

Preferably, the polyisocyanate is selected from methylene bis 4,4'-cyclohexyl-isocyanate; cyclohexyl diisocyanate; isophorone diisocyanate; hexamethylene diisocyanate; propylene-1,2-dissocyanate; tetramethylene-1,4-diisocyanate; 1,6-hexamethylene-diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of hexamethylene diisocyanate; triisocyanate of 2,4,4-trimethyl-1,6-hexane diisocyanate; urtdione of hexamethylene diisocyanate; ethylene diisocyanate; 2,2,4-trimethylhexamethylene diisocyanate; 2,4,4-tri-methylhexamethylene diisocyanate; dicyclohexylmethane diisocyanate; and combinations thereof. Most preferably, the polyisocyanate is aliphatic and has less than 14 percent unreacted isocyanate groups.

Preferably, the hydroxyl-containing material used with the present invention is a polyol. Exemplary polyols include, for example, polyether polyols, hydroxy-terminated polybutadiene (including partially and fully hydrogenated derivatives), polyester polyols, polycaprolactone polyols, polycarbonate polyols, and mixtures thereof.

Preferred polyols include polyether polyols Examples of polyether polyols include polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof The hydrocarbon chain can have saturated or unsaturated bonds, or substituted or unsubstituted aromatic and cyclic groups. Suitable polycaprolactone polyols include, but are not limited to, 1,6-hexanediol-initiated polycaprolactone; diethylene initiated polycaprolactone; trimethylol propane initiated polycaprolactone; neopentyl initiated polycaprolactone; 1,4-butanediol-initiated polycaprolactone; PTMEG-initiated polycaprolactone; and mixtures thereof. The hydrocarbon chain can have saturated or unsaturated bonds, or substituted or unsubstituted aromatic and cyclic groups. Suitable polycarbonates include, but are not limited to, polyphthalate carbonate and poly(hexamethylene carbonate) glycol.

Preferably, the plurality of microelements are selected from entrapped gas bubbles, hollow core polymeric materials (i.e., microspheres), liquid filled hollow core polymeric materials, water soluble materials (e.g., cyclodextrin) and an insoluble phase material (e.g., mineral oil). Preferably, the plurality of microelements are microspheres, such as, polyvinyl alcohols, pectin, polyvinyl pyrrolidone, hydroxyethylcellulose, methylcellulose, hydropropylmethylcellulose, carboxymethylcellulose, hydroxypropylcellulose, polyacrylic acids, polyacrylamides, polyethylene glycols, polyhydroxyetheracrylites, starches, maleic acid copolymers, polyethylene oxide, polyurethanes, cyclodextrin and combinations thereof (e.g., Expancel™ from Akzo Nobel of Sundsvall, Sweden). The microspheres can be chemically modified to change the solubility, swelling and other properties by branching, blocking, and crosslinking, for example. Preferably, the microspheres have a mean diameter that is less than 150 μm, and more preferably a mean diameter of less than 50 μm. Most Preferably, the microspheres 48 have a mean diameter that is less than 15 μm. Note, the mean diameter of the microspheres can be varied and different sizes or mixtures of different microspheres 48 can be used. A most preferred material for the microspheres is a copolymer of acrylonitrile and vinylidene chloride (e.g., Expancel® available from Akzo Nobel).

The liquid prepolymer material optionally further comprises a curing agent. Preferred curing agents include diamines. Suitable polydiamines include both primary and secondary amines, Preferred polydiamines include, but are not limited to, diethyl toluene diamine ("DETDA"); 3,5-dimethylthio-2,4-toluenediamine and isomers thereof; 3,5-diethyltoluene-2,4-diamine and isomers thereof (e.g., 3,5-diethyltoluene-2,6-diamine); 4,4'-bis-(sec-butylamino)-diphenylmethane; 1,4-bis-(sec-butylamino)-benzene; 4,4'-methylene-bis-(2-chloroaniline); 4,4'-methylene-bis-(3-chloro-2,6-diethylaniline) ("MCDEA"); polytetramethyleneoxide-di-p-aminobenzoate; N,N'-dialkyl-diamino diphenyl methane; p,p'-methylene dianiline ("MDA"); m-phenylenediamine ("MPDA"); methylene-bis 2-chloroaninine ("MBOCA"); 4,4'-methylene-bis-(2-chloroaniline) ("MOCA"); 4,4'-methylene-bis-(2,6-diethylaniline) ("MDEA"); 4,4'-methylene-bis-(2,3-dichloroaniline) ("MDCA"); 4,4'-diamino-3,3'-diethyl-5,5'-dimethyl diphenylmethane, 2,2',3,3'-tetrachloro diamino diphenylmethane; trimethylene glycol di-p-aminobenzoate; and mixtures thereof. Preferably, the diamine curing agent is selected from 3,5-dimethylthio-2,4-toluenediamine and isomers thereof.

Curing agents can also include diols, triols, tetraols and hydroxy-terminated curatives. Suitable diols, triols, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy)ethoxy]benzene; 1,3-bis-{2-[2-(2-hydroxyethoxy) ethoxy]ethoxy}benzene; 1,4-butanediol; 1,5-pentanediol; 1,6-hexanediol; resorcinol-di-(beta-hydroxyethyl) ether; hydroquinone-di-(beta-hydroxyethyl) ether; and mixtures thereof. Preferred hydroxy-terminated curatives include 1,3-bis(2-hydroxyethoxy) benzene; 1,3-bis-[2-(2-hydroxyethoxy) ethoxy]benzene; 1,3-bis-{2-[2-(2-hydroxyethoxy) ethoxy]ethoxy}benzene; 1,4-butanediol; and mixtures thereof. The hydroxy-terminated and diamine curatives can include one or more saturated, unsaturated, aromatic, and cyclic groups. Additionally, the hydroxy-terminated and diamine curatives can include one or more halogen groups.

Preferably, the cake is skived, or similarly sectioned, into a plurality of polishing layers of desired thickness.

Preferably, the method of the present invention of forming a polishing layer for a chemical mechanical polishing pad, further comprises: providing a window block and locating the window block in the mold cavity. The window block can be located in the mold cavity before or after the curable mixture is transferred to the mold cavity. Preferably, the window block is located in the mold cavity before the curable mixture is transferred to the mold cavity. Preferably, the method of the present invention, further comprises: securing the window block to the mold base (preferably to the horizontal internal boundary of the mold base). Preferably, the method of the present invention, further comprises: providing a window block adhesive and securing the window block to the mold base (preferably to the horizontal internal boundary of the mold base). It is believed that securing of the window block to the mold base alleviates the formation of window distortions (e.g., window bulging outward from the polishing layer) when sectioning (e.g., skiving) a cake into a plurality of polishing layers.

Window block formulations suitable for use in chemical mechanical polishing pads are well known in the art.

Preferably, cakes produced using the method of the present invention contain fewer density defects compared to cakes produced using the same process except that throughout the charging period, CP, the location of the nozzle opening moves in only one dimension along the mold cavity's central axis, $C_{axis}$, (i.e., to maintain the location of the nozzle opening at a set elevation above the top surface of the curable material as it collects in the mold cavity). More preferably, wherein cakes produced using the method of the present invention provide at least 50% more (more preferably at least 75% more; most preferably at least 100% more) density defect free polishing layers per cake. Still more preferably, wherein the mold cavity has a substantially circular cross section having an average radius, $r_C$; wherein $r_C$ is 40 to 60 cm; and wherein the cake produced using the method of the present invention provides a 2 fold increase (more preferably a 3 fold increase) in the number of density defect free polishing layers compared to the number of density defect free polishing layers provided by a cake produced using the same process except that throughout the charging period, CP, the location of the nozzle opening moves in only one dimension along the mold cavity's central axis, $C_{axis}$.

We claim:

1. A method of forming a polishing layer for a chemical mechanical polishing pad, comprising:

providing a mold, having a mold base and a surrounding wall, wherein the mold base and the surrounding wall define a mold cavity, wherein the mold base is oriented along an x-y plane, wherein the mold cavity has a central axis, $C_{axis}$, that is perpendicular to the x-y plane, and wherein the mold cavity has a doughnut hole region and a doughnut region;

providing a liquid prepolymer material;

providing a plurality of microelements;

providing a nozzle, having a nozzle opening;

combining the liquid prepolymer material with the plurality of microelements to form a curable mixture;

charging the curable mixture through the nozzle opening to the mold cavity during a charging period, CP, wherein the charging period, CP, is broken down into three separate phases identified as an initial phase, a transition phase and a remainder phase;

wherein the nozzle opening has a location and wherein the location of the nozzle opening moves relative to mold base along the mold cavity's central axis, $C_{axis}$, during the charging period, CP, to maintain the location of the nozzle opening above a top surface of the curable mixture in the mold cavity as the curable mixture collects in the mold cavity;

wherein the location of the nozzle opening resides within the doughnut hole region throughout the initial phase;

wherein the location of the nozzle opening transitions from residing within the doughnut hole region to residing within the doughnut region during the transition phase;

wherein the location of the nozzle opening resides within the doughnut region during the remainder phase;

wherein the mold cavity is symmetric about the mold cavity's central axis, $C_{axis}$;

wherein the mold cavity approximates a right cylindrically shaped region having a substantially circular cross section, $C_{x\text{-}sect}$; wherein the mold cavity has an axis of symmetry, $C_{x\text{-}sym}$, which coincides with the mold cavity's central axis, $C_{axis}$; wherein the right cylindrically shaped region has a cross sectional area, $C_{x\text{-}area}$, defined as follows:

$$C_{x\text{-}area}=\pi r_C^2,$$

wherein $r_C$ is the average radius of the mold cavity's cross sectional area, $C_{x\text{-}area}$, projected onto the x-y plane; wherein the doughnut hole region is a right cylindrically shaped region within the mold cavity that projects a circular cross section, $DH_{x\text{-}sect}$, onto the x-y plane and has an axis of symmetry, $DH_{axis}$; wherein the doughnut hole has a cross sectional area, $DH_{x\text{-}axis}$, defined as follows:

$$DH_{x\text{-}area}=\pi r_{DH}^2,$$

wherein $r_{DH}$ is a radius of the doughnut hole region's circular cross section, $DH_{x\text{-}sect}$; wherein the doughnut region is a toroid shaped region within the mold cavity that projects an annular cross section, $D_{x\text{-}sect}$, onto the x-y plane and that has a doughnut region axis of symmetry, $D_{axis}$; wherein the annular cross section, $D_{x\text{-}sect}$, has a cross sectional area $D_{x\text{-}area}$, defined as follows:

$$D_{x\text{-}area}=\pi R_D^2-\pi r_D^2,$$

wherein $R_D$ is a larger radius of the doughnut region's annular cross section, $D_{x\text{-}sect}$; wherein $r_D$ is a smaller radius of the doughnut region's annular cross section, $D_{x\text{-}sect}$; wherein $r_D \geqq r_{DH}$; wherein $R_D > r_D$; wherein $R_D < r_C$; wherein each of the $C_{x\text{-}sym}$, the $DH_{axis}$ and the $D_{axis}$ are perpendicular to the x-y plane;

allowing the curable mixture in the mold cavity to cure into a cake; and, deriving the polishing layer from the cake.

2. The method of claim 1, wherein the mold base defines a horizontal internal boundary of the mold cavity; and wherein the horizontal internal boundary is flat.

3. The method of claim 1, wherein the movement of the location of the nozzle opening momentarily pauses in its motion relative to the mold cavity's central axis, $C_{axis}$, during the remainder phase.

4. The method of claim 1, wherein the curable mixture is charged to the mold cavity at an essentially constant rate over the charging period, CP, with an average charging rate, $CR_{avg}$ of 0.015 to 2 kg/see.

5. The method of claim 1, wherein the mold cavity is symmetric about the mold cavity's central axis, $C_{axis}$.

6. The method of claim 1, wherein $R_D \leqq (K^* r_C)$, wherein K is 001 to 0.2.

7. The method of claim 1, wherein $r_D = r_{DH}$; wherein $r_D$ is 5 to 25 mm; wherein $R_D$ is 20 to 100 mm; wherein $r_C$ is 20 to 100 cm.

8. The method of claim 1, wherein deriving the polishing layer from the cake, comprises:

skiving the cake into a plurality of polishing layers.

9. The method of claim 1, wherein the curable mixture is charged to the mold cavity at an essentially constant rate over the charging period, CP, with an average charging rate, $CR_{avg}$, of 0.015 to 1 kg/sec.

10. The method of claim 1, wherein the curable mixture is charged to the mold cavity at an essentially constant rate over the charging period, CP, with an average charging rate, $CR_{avg}$, of 0.08 to 0.4 kg/see.

11. The method of claim 1, wherein $R_D \leqq (K^* r_C)$, wherein K is 0.014 to 0.1.

12. The method of claim 1, wherein $R_D \leqq (K^* r_C)$, wherein K is 0.04 to 0.086.

13. The method of claim 1, wherein $r_D$ is 8 to 15 mm; wherein $R_D$ is 25 to 50 mm mm; wherein $r_C$ is 40 to 60 cm.

14. The method of claim 1, wherein the transition phase is 0.02 to 30 seconds long; and, wherein the remainder phase is $\geqq$10 seconds long.

15. The method of claim 1, wherein the location of the nozzle opening moves relative to the mold cavity's central axis, $C_{axis}$, during the transition phase at an average speed of 10 to 70 mm/see; and, wherein the location of the nozzle opening moves relative to the mold cavity's central axis, $C_{axis}$, during the remainder phase at an average speed of 10 to 70 mm/sec.

16. The method of claim 1, wherein during the remainder phase the location of the nozzle opening moves from a remainder phase starting point, $SP_{RP}$, through a plurality of remainder phase transition points, $TP_{RP}$;

wherein a remainder phase path projects a series of connected lines onto the x-y plane during the remainder phase;

wherein the plurality of remainder phase transition points, $TP_{RP}$, are all located within the doughnut region of the mold cavity; and, wherein the series of connected lines approximates a circle or a two dimensional spiral with a varying distance from the mold cavity's central axis, $C_{axis}$.

17. The method of claim 16, wherein the transition phase is 0.2 to 5 seconds long;

wherein the remainder phase is 30 to <(CP-0.2) seconds long;

wherein the location of the nozzle opening moves relative to the mold cavity's central axis, $C_{axis}$, during the transition phase at an average speed of 20 to 30 mm/sec; and, wherein the location of the nozzle opening moves relative to the mold cavity's central axis, $C_{axis}$, during the remainder phase at an average speed of 20 to 30 mm/sec.

18. The method of claim 16, wherein the series of connected lines is a regular polygon; and, wherein the regular polygon has $\geqq$5 sides and $\leqq$20 sides.

19. The method of claim 17, wherein the series of connected lines is a regular polygon; and, wherein the regular polygon has $\geqq$5 sides and $\leqq$20 sides.

20. The method of claim 17, wherein the series of connected lines is a regular polygon; and, wherein the regular polygon has 8 to 15 sides.

* * * * *